US009759437B2

(12) United States Patent
Kim et al.

(10) Patent No.: US 9,759,437 B2
(45) Date of Patent: Sep. 12, 2017

(54) DEHUMIDIFICATION SYSTEM

(71) Applicant: KOREA INSTITUTE OF ENERGY RESEARCH, Daejeon (KR)

(72) Inventors: Min Sung Kim, Daejeon (KR); Gil Bong Lee, Daejeon (KR); Young Jin Baik, Daejeon (KR); Jun Hyun Cho, Daejeon (KR); Ho Sang Ra, Daejeon (KR)

(73) Assignee: KOREA INSTITUTE OF ENERGY RESEARCH, Daejeon (KR)

( * ) Notice: Subject to any disclaimer, the term of this patent is extended or adjusted under 35 U.S.C. 154(b) by 262 days.

(21) Appl. No.: 14/818,245

(22) Filed: Aug. 4, 2015

(65) Prior Publication Data

US 2017/0010007 A1 Jan. 12, 2017

(30) Foreign Application Priority Data

Jul. 7, 2015 (KR) ..... 10-2015-0096305

(51) Int. Cl.

| | |
|---|---|
| ***F24F 3/147*** | (2006.01) |
| ***F28D 21/00*** | (2006.01) |
| ***F24F 7/08*** | (2006.01) |
| ***F24F 11/00*** | (2006.01) |
| *F24F 3/14* | (2006.01) |

(52) U.S. Cl.

CPC ..... *F24F 3/147* (2013.01); *F24F 7/08* (2013.01); *F24F 11/0015* (2013.01); *F28D 21/0015* (2013.01); *F24F 2003/144* (2013.01); *F24F 2003/1435* (2013.01)

(58) Field of Classification Search

CPC ..... F24F 2003/1435; F24F 2003/144; F24F 11/0015; F24F 3/147; F24F 7/08; F28D 21/0015

See application file for complete search history.

(56) References Cited

U.S. PATENT DOCUMENTS

| | | | | |
|---|---|---|---|---|
| 6,361,588 | B1 * | 3/2002 | Moratalla | B01D 53/22 55/521 |
| 7,013,950 | B2 * | 3/2006 | Steneby | F24F 11/0079 165/11.1 |
| 7,036,560 | B1 * | 5/2006 | Rylewski | F24F 1/0007 165/165 |
| 2005/0072303 | A1 * | 4/2005 | Weidenmann | B01D 53/268 96/4 |

(Continued)

FOREIGN PATENT DOCUMENTS

KR 10-0761952 B1 9/2007

*Primary Examiner* — Devon Russell

(74) *Attorney, Agent, or Firm* — Revolution IP, PLLC

(57) ABSTRACT

A dehumidification system including: an exhaust path for exhausting indoor air to the outdoor space; an inlet path for entering outdoor air to the indoor space from the outdoor space; an indoor air bypass path bypassing a part of indoor air to be exhausted to the exhaust path to the inlet path by connecting the exhaust path and the inlet path; an outdoor air bypass path bypassing a part of outdoor air to be flowed to the inlet path to the exhaust path by connecting the inlet path and the exhaust path; and a porous separation membrane filter installed between the indoor air bypass path and the outdoor air bypass path and passing water molecules included in indoor air passing through the indoor air bypass path through the outdoor air bypass path.

10 Claims, 4 Drawing Sheets

(56) References Cited

U.S. PATENT DOCUMENTS

| | | | | |
|---|---|---|---|---|
| 2006/0270335 | A1* | 11/2006 | Kim | F24F 3/147 454/237 |
| 2007/0039343 | A1* | 2/2007 | Ikegami | B01D 53/263 62/271 |
| 2007/0151447 | A1* | 7/2007 | Merkel | B01D 53/228 95/52 |
| 2009/0038326 | A1* | 2/2009 | Matsui | F24F 3/1411 62/271 |
| 2010/0170280 | A1* | 7/2010 | Narikawa | F24F 3/1411 62/271 |
| 2012/0012290 | A1* | 1/2012 | Breshears | F24F 3/147 165/164 |
| 2012/0118155 | A1* | 5/2012 | Claridge | B01D 53/268 96/9 |
| 2012/0247135 | A1* | 10/2012 | Fakieh | E03B 3/28 62/129 |
| 2013/0020049 | A1* | 1/2013 | Breshears | F24F 12/006 165/53 |
| 2013/0126123 | A1* | 5/2013 | Breshears | F24F 3/147 165/54 |
| 2015/0325868 | A1* | 11/2015 | Fasold | H01M 8/04149 429/413 |
| 2017/0097165 | A1* | 4/2017 | Yasuda | F24F 3/14 |
| 2017/0108231 | A1* | 4/2017 | Hasegawa | F24F 3/147 |
| 2017/0159963 | A1* | 6/2017 | Matsugi | F24F 12/006 |

* cited by examiner

[Fig.1]
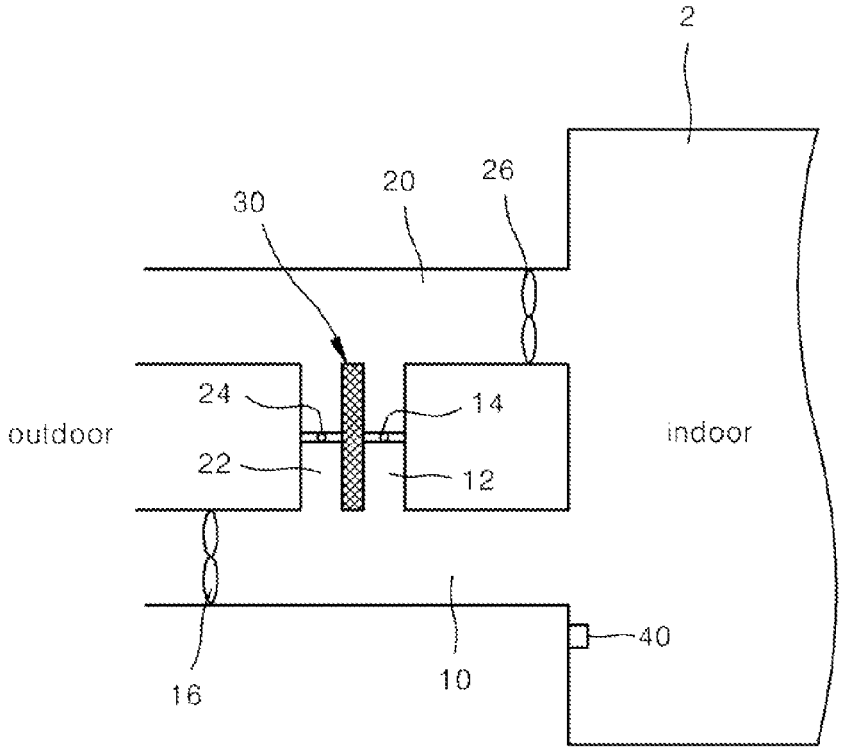

[Fig.2]
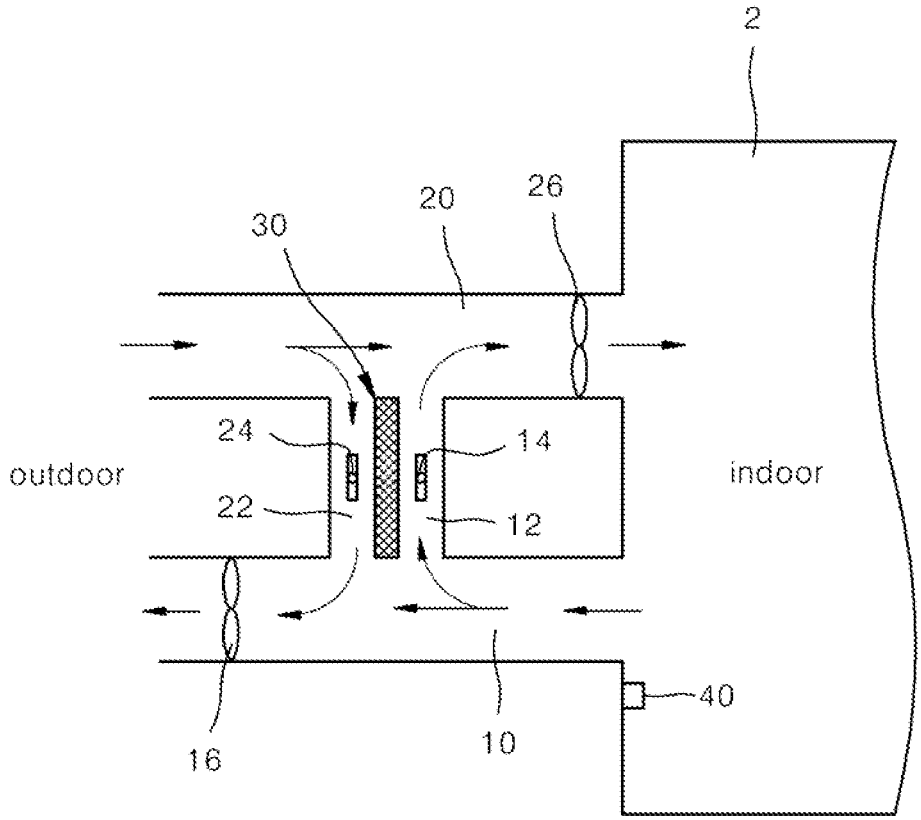

[Fig.3]
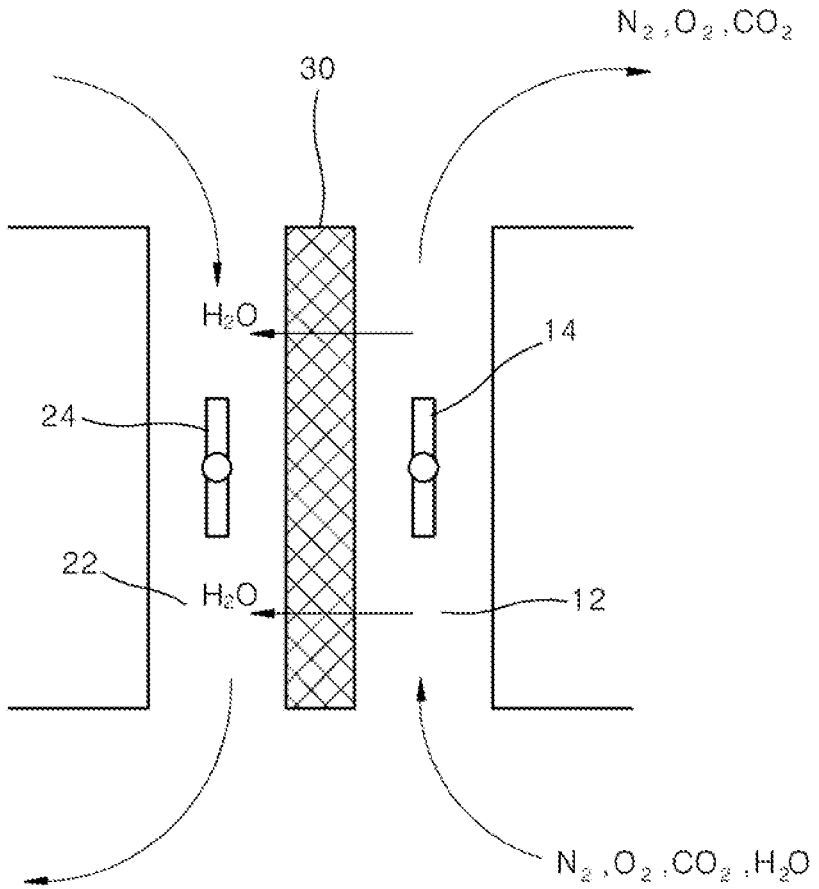

[Fig.4]
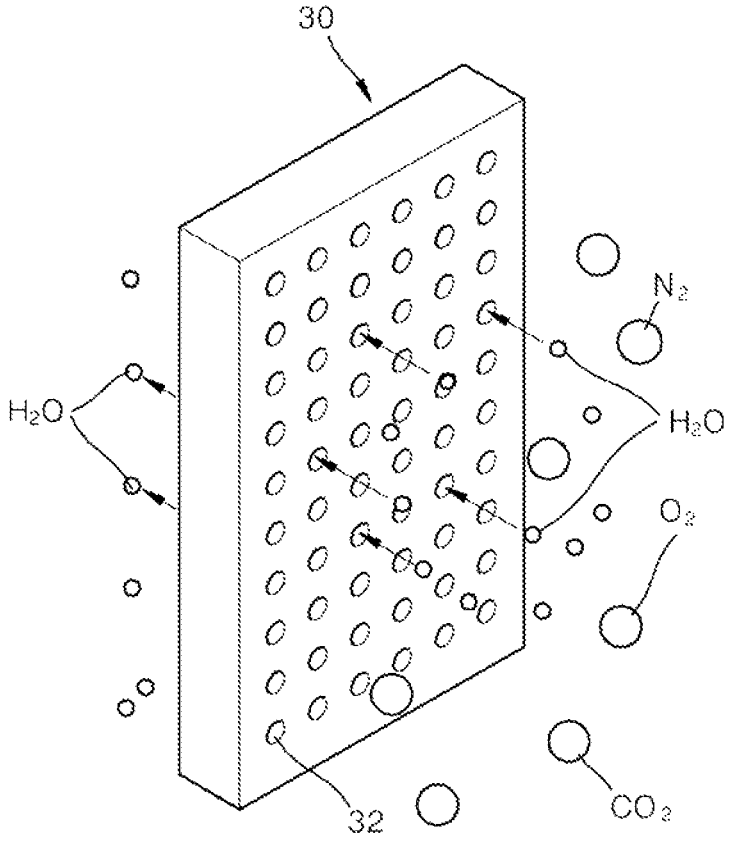

DEHUMIDIFICATION SYSTEM

CROSS-REFERENCE TO RELATED APPLICATIONS

This application claims priority under 35 U.S.C. §119 to Korean Patent Application No. 10-2015-0096305, filed on Jul. 07, 2015, in the Korean Intellectual Property Office, the entire contents of which are incorporated herein by reference.

BACKGROUND

Example embodiments of inventive concepts relate to a dehumidification system, and more particularly, to a dehumidification system performing dehumidification function efficiently while circulating indoor air.

Conventional methods of dehumidifying indoor air are ventilating indoor air, using a dehumidifying agent, and cooling using a compressor. The ventilating indoor air is recirculation of a part of indoor air and providing outdoor air into indoor air, which has limitation to reduce the humidity due to high humidity of recirculated air.

The method of using a dehumidifying agent is absorbing moisture in air by using a moisture absorbent such as silica gel adsorbing moisture, which has limitation to reduce the humidity by removing a relatively small amount of moisture in the enclosed space. Also, conventional methods of using a dehumidifying agent or hydrophile coating layer necessarily accompany phase change during condensation process, accordingly resulting in generation of condensation heat.

The method of cooling using a compressor is capable of dehumidification with regards to mass air by removing moisture of indoor air by condensing with a refrigeration cycle, but consuming significant power and generating condensation heat during condensation performance may be problems.

DETAILED DESCRIPTION OF THE INVENTION

Technical Goal of the Invention

According to an exemplary embodiment, the inventive concept provides a dehumidification system without using a condenser for minimizing energy consumption as well as obtaining dehumidification effect.

Technical Solution of the Invention

A dehumidification system according to an exemplary embodiment of inventive concept includes an exhaust path for exhausting indoor air to the outdoor space, an inlet path for entering outdoor air to the indoor space from the outdoor space, an indoor air bypass path bypassing a part of indoor air being exhausted to the exhaust path to the inlet path by connecting the exhaust path and the inlet path, an outdoor air bypass path bypassing a part of outdoor air being flowed to the inlet path to the exhaust path by connecting the inlet path and the exhausting path; a porous separation membrane filter passing water molecules included in indoor air passing through the indoor air bypass path to the outdoor air bypass path.

A dehumidification system according to another exemplary embodiment of inventive concept includes an exhaust path for exhausting indoor air to the outdoor space, an inlet path for entering outdoor air to the indoor space from the outdoor space, an indoor air bypass path bypassing a part of indoor air being exhausted to the exhaust path to the inlet path by connecting the exhaust path and the inlet path, an outdoor air bypass path bypassing a part of outdoor air being flowed to the inlet path to the exhaust path by connecting the inlet path and the exhausting path; a porous separation membrane filter passing water molecules included in indoor air passing through the indoor air bypass path to the outdoor air bypass path, an exhaust fan installed in the exhaust path, which is close to the side of the outdoor space more than the outdoor air bypass path is; an inlet fan installed in the inlet path, which is close to the side of the indoor space more than the indoor air bypass path is; an indoor air damper is installed in the indoor air bypass path and controls the amount of indoor air flow being bypassed; and an outdoor air damper is installed in the outdoor air bypass path and controls the amount of outdoor air flow being bypassed.

A dehumidification system according to yet another exemplary embodiment of inventive concept includes an exhaust path for exhausting indoor air to the outdoor space, an inlet path for entering outdoor air to the indoor space from the outdoor space, an indoor air bypass path bypassing a part of indoor air being exhausted to the exhaust path to the inlet path by connecting the exhaust path and the inlet path, an outdoor air bypass path bypassing a part of outdoor air being flowed to the inlet path to the exhaust path by connecting the inlet path and the exhausting path; a porous separation membrane filter passing water molecules included in indoor air passing through the indoor air bypass path to the outdoor air bypass path, an exhaust fan installed in the exhaust path, which is close to the side of the outdoor space more than the outdoor air bypass path is; an inlet fan installed in the inlet path, which is close to the side of the indoor space more than the indoor air bypass path is; an indoor air damper is installed in the indoor air bypass path and controls the amount of indoor air flow being bypassed, an outdoor air damper is installed in the outdoor air bypass path and controls the amount of outdoor air flow being bypassed, a sensor measuring the humidity of indoor air, and a control unit controls the degree of openness of the indoor air damper and the outdoor air damper according to the humidity measured by the sensor and the speed of spinning of the exhaust fan to be faster than the speed of spinning of the inlet fan.

Effect of the Invention

A dehumidification system according to embodiments of the present invention may minimize the amount of energy consumption through dehumidification of indoor air without power waste and condensation heat by transferring water molecules of indoor air to outdoor air through a porous separation membrane filter.

BRIEF DESCRIPTION OF THE DRAWINGS

Exemplary embodiments of the inventive concept will be more clearly understood from the following detailed description taken in conjunction with the accompanying drawings in which:

FIG. 1 is a schematic drawing of a dehumidification system according to an exemplary embodiment of the inventive concept;

FIG. 2 is a drawing illustrating operation status of the dehumidification system of FIG. 1;

FIG. 3 is an expanded drawing of a porous separation membrane filter in FIG. 2; and FIG. 4 is a schematic drawing illustrating the status that water molecules passing through the porous separation membrane filter according to an exemplary embodiment of the inventive concept.

BEST MODE FOR CARRYING OUT THE INVENTION

Various example embodiments will be described more fully hereinafter with reference to the accompanying drawings, in which some example embodiments are shown. Inventive concepts may, however, be embodied in many different forms and should not be construed as limited to the example embodiments set forth herein. Rather, example embodiments are provided so that this disclosure will be thorough and complete, and will fully convey the scope of inventive concepts to those skilled in the art. In the drawings, the sizes and relative sizes of layers and areas may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the inventive concepts. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacently" versus "directly adjacently," etc.).

The terminology used herein is for the purpose of describing particular example embodiments only and is not intended to be limiting of the inventive concepts. As used herein, the singular forms "a," "an" and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which inventive concepts belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a schematic drawing of a dehumidification system according to an exemplary embodiment of the inventive concept. FIG. 2 is a drawing illustrating the operation status of the dehumidification system of FIG. 1.

Referring to FIGS. 1 and 2, the dehumidification system includes an exhaust path 10, an inlet path 20, an indoor air bypass path 12, an outdoor air bypass path 22, and a porous separation membrane filter 30.

The exhaust path 10 is for exhausting indoor air of indoor space 2 to the outdoor space. The exhaust path 10 includes an exhaust fan 16 for blowing the indoor air out so as to be exhausted.

The exhaust fan 16 is located closer to the outdoor space than the outdoor air bypass path 22 in the exhaust path 10. Accordingly, outdoor air bypassed to the outdoor air bypass path 22 as well as the indoor air maybe exhausted when the exhaust fan 16 is operated. The speed of spinning of the exhaust fan is set to be faster than the one of an inlet fan 26 will be described next, thereby the air pressure inside the indoor air bypass path 12 being higher than the air pressure inside the outdoor air bypass path 22.

The inlet path 20 is a path for entering outdoor air to the indoor space 2 from the outdoor space. The inlet path 20 is prepared separately with the exhaust path 10 and arranged in parallel with the exhaust path 10. The inlet path 20 includes an inlet fan 26 for blowing out the indoor air so as to be flowed the indoor space 2.

The inlet fan 26 is located closer to the indoor space than the indoor air bypass path 12 in the inlet path 20. Accordingly, indoor air bypassed to the indoor air bypass path 12 as well as the outdoor air may enter the indoor space 2 when the inlet fan 26 is operated.

The indoor air bypass path 12 is a path for guiding a part of indoor air to be exhausted to the exhaust path 10 to be bypassed to the inlet path 20. The indoor air bypass path 12 connects the exhaust path 10 and the inlet path 20. An indoor air damper 14 is installed in the indoor air bypass path 12 for adjusting the amount of indoor air flow to be bypassed.

The outdoor air bypass path 22 is a path for guiding a part of outdoor air to be flowed into the inlet path 20. The outdoor air bypass path 22 connects the exhaust path 10 and the inlet path 20. An outdoor air damper 24 is installed in the outdoor air bypass path 22 for adjusting the amount of outdoor air flow to be bypassed.

The porous separation membrane filter 30 is located between the indoor air bypass path 12 and the outdoor air bypass path 22 referring to FIGS. 3 and 4.

According to the present exemplary embodiment, the porous separation membrane filter 30 divides the indoor air bypass path 12 and the outdoor air bypass path 22, but the embodiments are not restricted thereto, and the porous separation membrane filter 30 may be installed in a through hole prepared between the indoor air bypass path 12 and the outdoor air bypass path 22 while the indoor air bypass path 12 and the outdoor air bypass path 22 are separately installed in other embodiments. That is, one side of the porous separation membrane filter 30 is positioned in the indoor air bypass path 12 to contact the indoor air, and the other side of the porous separation membrane filter 30 is positioned in the outdoor air bypass path 22 to contact the outdoor air. The porous separation membrane filter 30 includes a plurality of holes **30*a* passing only water molecules included in the indoor air. The size of the holes 30*a*** is larger than the one of the water molecule included in the indoor air and smaller than those of nitrogen (N2), oxygen (O2), and carbon dioxide (CO2) molecules.

Also, a sensor 40 measuring the humidity of the indoor air is installed in the indoor space 2. But the embodiment is not restricted thereto, and the sensor 40 may be installed in the exhaust path 10 in other embodiments.

Also, a control unit (not shown) controlling the degree of openness of the indoor air damper 14 and the outdoor air damper 24 according to the humidity measured by the sensor 40 is further prepared. The control unit also controls the operation of the inlet fan 26 and the exhaust fan 16.

The sensor 40 measures only the humidity of indoor air, but the other sensor measuring the humidity of outdoor air entering the inlet path 20 may be installed separately. In that case, the control unit (not shown) may compare the humidity of the indoor air and the one of the outdoor air and control the degree of openness of the indoor damper 14 and the outdoor damper 24 accordingly.

The operation of the dehumidification system according to an exemplary embodiment of the inventive concept will be described.

The sensor 40 measures the humidity of indoor air at first, and then, the control unit (not shown) compares the humidity measured by the sensor 40 with the premeasured reference humidity.

The control unit (not shown) may determine that the dehumidification for indoor space 2 is required when the humidity measured by the sensor 40 is higher than the reference humidity.

The control unit (not shown) opens both of the indoor air damper 14 and the outdoor air damper 24. At this time, the degree of openness of the indoor air damper 14 and the one of the outdoor air damper 24 may be adjusted according to the humidity measured by the sensor 40. For example, the degree of openness of the indoor air damper 14 and outdoor damper 24 may be increased as the difference between the humidity measured by the sensor 40 and the reference humidity become larger. The degree of openness of the indoor air damper 14 based on the humidity measured by the sensor 40 and the degree of openness of the outdoor air damper 24 may be preset and saved.

Also, the control unit (not shown) operates the inlet fan 26 and the exhaust fan 16. At this time, the control unit controls the speed of spinning of the exhaust fan 26 to be faster than the speed of spinning of inlet fan 16 such that the air pressure inside the indoor air bypass path 12 may be higher than the one inside the outdoor air bypass path 22. Water molecules in the indoor air bypass path 12 may transfer to the outdoor air bypass path 22 smoothly, when the air pressure inside the indoor air bypass path 12 is higher than the one inside the outdoor air bypass path 22.

Once the exhaust fan 16 operates, indoor air of the indoor space 2 is exhausted to the outside space through the exhaust path 10.

At this time, a part of the indoor air being exhausted through the exhaust path 10 is bypassed to the indoor air bypass path 12 when the indoor air damper 14 opens.

Meanwhile, once the inlet fan 26 operates, outdoor air enters the indoor space 2 through the inlet path 20.

At this time, a part of the outdoor air entering through the inlet path 20 is bypassed to the outdoor air bypass path 22 when the outdoor damper 24 opens.

Accordingly, a part of the indoor air being exhausted through the exhaust path 10 passes through the indoor air bypass path 12 and the one side of the porous separation membrane filter 30, and a part of the outdoor air passing through the inlet path 20 passes through the outdoor air bypass path 22 and the other side of the porous separation membrane filter 30.

At this time, the humidity of the indoor air is higher than the reference humidity, accordingly, the concentration of water molecules in the indoor air passing through the indoor air bypass path 12 is higher than the concentration of water molecules in the outdoor air passing through the outdoor air bypass path 22.

Also, the air pressure in the indoor air bypass path 12 is higher than the air pressure in the outdoor air circulation path 22. Accordingly, water molecules included in the indoor air passing through the indoor air bypass path 12 may be transferred to the outdoor air bypass path 22.

At this time, the indoor air includes nitrogen (N2), oxygen (O2), and carbon dioxide (CO2) besides water molecules, accordingly, the holes 32 of the porous separation membrane filter 30 is larger than the size of the water molecule and smaller than the sizes of nitrogen (N2), oxygen (O2), and carbon dioxide (CO2) molecules such that only water molecules may be transferred.

As a result, water molecules are removed from the indoor air by the porous separation membrane filter 30 while the indoor air passing through the indoor air bypass path 12 to perform dehumidification of the indoor air. The indoor air undergone dehumidification while passing through the indoor air bypass path 12 is recirculated to the indoor space 2 through the inlet path 20.

Meanwhile, the outdoor air absorbs water molecules passed through the porous separation membrane filter 30 while passing through the outdoor bypass path 22 and is exhausted to the outdoor space through the exhaust path 10.

Meanwhile, the control unit (not shown) stops dehumidification of the indoor space 2 when the humidity measured by the sensor 40 becomes below the reference humidity.

The dehumidification system according to the inventive concept may minimize energy consumption because it may not require power and not generate condensation heat by performing dehumidification of the indoor air using the porous separation membrane filter 30.

While the present invention has been particularly shown and described with reference to exemplary embodiments thereof, it will be understood that various changes in form and details may be made therein without departing from the spirit and scope of the following claims.

What is claimed is:

1. A dehumidification system comprising:

an exhaust path for exhausting indoor air to an outdoor space;

an inlet path for entering outdoor air to an indoor space from the outdoor space;

an indoor air bypass path bypassing a part of the indoor air flowing into the exhaust path to the inlet path by connecting the exhaust path and the inlet path;

an outdoor air bypass path bypassing a part of the outdoor air flowing into the inlet path to the exhaust path by connecting the inlet path and the exhaust path; and a porous separation membrane filter installed between the indoor air bypass path and the outdoor air bypass path, the porous separation membrane filter passing water molecules included in the indoor air passing through the indoor air bypass path to the outdoor air bypass path.

2. The dehumidification system of claim 1, wherein the system further includes an exhaust fan installed in the exhaust path, which is closer to the side of the outdoor space than the outdoor air bypass path, and an inlet fan installed in the inlet path, which is closer to the side of the indoor space than the indoor air bypass path.

3. The dehumidification system of claim 2, wherein the speed of spinning of the exhaust fan is set to be faster than the speed of the inlet fan.

4. The dehumidification system of claim 1, wherein the system further includes an indoor air damper installed in the indoor air bypass path and controlling the amount of indoor air flow being bypassed.

5. The dehumidification system of claim 4, wherein the system further includes an outdoor air damper installed in the outdoor air bypass path and controlling the amount of outdoor air flow being bypassed.

6. The dehumidification system of claim 1, wherein the system further includes a sensor measuring the humidity of the indoor air and a control unit controlling the indoor air bypass path and the outdoor air bypass path to be opened when the humidity measured by the sensor is higher than a reference humidity.

7. The dehumidification system of claim 6, wherein the control unit closes the indoor air bypass path and the outdoor air bypass path when the humidity measured by the sensor is lower than the reference humidity.

8. The dehumidification system of claim 1, wherein the indoor air bypass path and the outdoor air bypass path are divided by the porous separation membrane filter.

9. A dehumidification system comprising:

an exhaust path for exhausting indoor air to an outdoor space;

an inlet path for entering outdoor air to an indoor space from the outdoor space;

an indoor air bypass path bypassing a part of the indoor air flowing into the exhaust path to the inlet path by connecting the exhaust path and the inlet path;

an outdoor air bypass path bypassing a part of the outdoor air flowing into the inlet path to the exhaust path by connecting the inlet path and the exhaust path; and a porous separation membrane filter installed between the indoor air bypass path and the outdoor air bypass path, the porous separation membrane filter passing water molecules included in the indoor air passing through the indoor air bypass path to the outdoor air bypass path;

an exhaust fan installed in the exhaust path, which is closer to the side of outdoor space than the outdoor air bypass path is;

an inlet fan installed in the inlet path, which is closer to the side of the indoor space than the indoor air bypass path is;

an indoor air damper installed in the indoor air bypass path, the indoor air damper controlling the amount of indoor air flow being bypassed; and an outdoor air damper installed in the outdoor air bypass path, the outdoor air damper controlling the amount of outdoor air flow being bypassed.

10. A dehumidification system comprising:

an exhaust path for exhausting indoor air to an outdoor space;

an inlet path for entering outdoor air to an indoor space from the outdoor space;

an indoor air bypass path bypassing a part of the indoor air flowing into the exhaust path to the inlet path by connecting the exhaust path and the inlet path;

an outdoor air bypass path bypassing a part of the outdoor air flowing into the inlet path to the exhaust path by connecting the inlet path and the exhaust path; and a porous separation membrane filter installed between the indoor air bypass path and the outdoor air bypass path, the porous separation membrane filter passing water molecules included in the indoor air passing through the indoor air bypass path to the outdoor air bypass path;

an exhaust fan installed in the exhaust path, which is closer to the side of outdoor space than the outdoor air bypass path is;

an inlet fan installed in the inlet path, which is closer to the side of the indoor space than the indoor air bypass path is;

an indoor air damper installed in the indoor air bypass path, the indoor air damper controlling the amount of indoor air flow being bypassed;

an outdoor air damper installed in the outdoor air bypass path, the outdoor air damper controlling the amount of outdoor air flow being bypassed;

a sensor measuring the humidity of the indoor air; and a control unit controlling the degree of openness of the indoor air damper and the outdoor air damper according to the humidity measured by the sensor, the control unit controlling the speed of spinning of the exhaust fan to be faster than the speed of spinning of the inlet fan.

* * * * *